US010004281B2

(12) United States Patent
Rowe et al.

(10) Patent No.: US 10,004,281 B2
(45) Date of Patent: Jun. 26, 2018

(54) PANTS CONFIGURED FOR MOTOR VEHICLE WORKERS

(71) Applicant: VF Imagewear, Inc., Nashville, TN (US)

(72) Inventors: Jennifer Rowe, Thompson Station, TN (US); Kathy Orrick, Mt. Juliet, TN (US); Nina Massey, Brentwood, TN (US)

(73) Assignee: VF IMAGEWEAR, INC., Nashville, TN (US)

( * ) Notice: Subject to any disclaimer, the term of this patent is extended or adjusted under 35 U.S.C. 154(b) by 157 days.

(21) Appl. No.: 14/247,582

(22) Filed: Apr. 8, 2014

(65) Prior Publication Data

US 2015/0282535 A1 Oct. 8, 2015

(51) Int. Cl.
*A41D 13/02* (2006.01)
*A41D 1/06* (2006.01)
(Continued)

(52) U.S. Cl.
CPC ..... *A41D 1/067* (2013.01); *A41F 9/02* (2013.01); *A41D 27/20* (2013.01)

(58) Field of Classification Search
CPC ..... A41D 1/067; A41D 1/06; A41D 13/0012; A41D 27/20; A41D 27/24; A41D 31/00;
(Continued)

(56) References Cited

U.S. PATENT DOCUMENTS 939,092 A * 11/1909 Robertson ..... A41F 1/02 24/659
1,616,763 A * 2/1927 Siebert ..... A41F 3/00 2/230

(Continued)

FOREIGN PATENT DOCUMENTS

WO 1989008410 A1 9/1989

OTHER PUBLICATIONS

International Search Report for PCT/US15/24603, dated Jun. 19, 2015, (7 Pages).

(Continued)

*Primary Examiner* — Sally Haden
(74) *Attorney, Agent, or Firm* — McAndrews, Held & Malloy, Ltd.

(57) ABSTRACT

The pant of the present invention is specifically inspired and configured for use in the motor vehicle industry. The pant may be scratchless, meaning that the pant does not have any exposed features that are capable of scratching the finish on a motor vehicle. For example, the pant may comprise a concealed waistband closure mechanism. The pant may also comprise a scratchless security pocket, which is predisposed toward a closed position and thus does not require the use of buttons or the like. The pant may also be configured to provide enhanced mobility and comfort, allowing a wearer a range of movements without interference from his or her clothing. For example, the pant may be manufactured from a stretchable material and/or may comprise a waistband that
(Continued)

is configured to stretch so as to provide increased mobility and comfort. The pant may also include an articulating, reinforcing knee feature, which provides additional strength to the knee portion of the pant while also providing for a more comfortable bend at the knee. Additionally, the pant may have reinforcement features, such as reinforced pockets or belt loops, which are particularly suitable for use by motor vehicle workers.

18 Claims, 2 Drawing Sheets

(51) Int. Cl.
*A41F 9/02* (2006.01)
*A41D 27/20* (2006.01)

(58) Field of Classification Search
CPC ..... A41D 2300/30; A41D 2300/50; A41D 2600/202; A41F 9/02; A41F 1/02
USPC ..... 24/114.12, 184, 163 FC
See application file for complete search history.

(56) References Cited

U.S. PATENT DOCUMENTS 1,951,098 A * 3/1934 Mann ..... A41F 9/007 2/237
2,023,194 A * 12/1935 Dann ..... A41F 9/002 2/312
2,194,100 A * 3/1940 Shikler ..... A41F 9/00 2/234
2,223,157 A 11/1940 Berger
2,253,816 A * 8/1941 Sherwood ..... A41F 9/002 2/321
2,364,062 A * 12/1944 Fleischer ..... A41F 1/004 112/408
2,373,594 A * 4/1945 Pecker ..... A41F 1/02 2/266
2,552,281 A * 5/1951 Isaacson ..... A41F 1/02 2/265
2,686,915 A * 8/1954 Gatto ..... A41B 1/10 2/128
2,721,330 A * 10/1955 Axler ..... A41F 9/02 2/237
2,832,962 A * 5/1958 Wendell ..... A41F 9/00 2/236
2,871,485 A * 2/1959 Greco ..... A41D 27/08 2/123
3,002,244 A 10/1961 McNamara
3,110,901 A * 11/1963 Lesnow ..... A41D 3/04 2/128
3,127,617 A * 4/1964 Bonzi ..... A41D 1/18 2/128
3,208,082 A * 9/1965 Di Paolo ..... A41F 1/00 2/219
3,345,644 A * 10/1967 Iannucci ..... A41F 1/00 2/96
3,495,274 A * 2/1970 Isaacs ..... A41D 1/02 2/96
3,624,840 A * 12/1971 Kahn ..... A41F 1/00 2/128
3,793,646 A * 2/1974 Tempelhof ..... A41D 1/06 2/227
3,843,973 A * 10/1974 Dillenburger ..... A41F 9/00 2/236
4,580,298 A * 4/1986 Tuisl ..... A41F 9/025 2/220
4,596,055 A * 6/1986 Aach ..... A41F 9/025 2/237
5,050,244 A * 9/1991 Kleinman ..... A41D 1/067 2/227
5,867,836 A * 2/1999 Quinones ..... A41F 9/02 2/221
6,026,516 A * 2/2000 Dacyshyn ..... A41D 1/082 2/227
6,199,215 B1 * 3/2001 Biggerstaff ..... A41D 1/06 2/234
6,311,333 B1 11/2001 Batra
7,793,359 B2 * 9/2010 Spiewak ..... A41D 1/002 2/247
7,958,569 B2 * 6/2011 Razzaghi ..... A41D 13/0002 2/62
D690,080 S 9/2013 Grosbol
D690,081 S 9/2013 Grosbol
D690,082 S 9/2013 Grosbol
D690,083 S 9/2013 Grosbol
D690,084 S 9/2013 Grosbol
2009/0282600 A1 * 11/2009 Robinson ..... A41D 27/20 2/79
2010/0325775 A1 * 12/2010 Fattal ..... A41F 1/004 2/128
2013/0007947 A1 * 1/2013 Moore ..... A41D 7/005 2/236
2013/0298311 A1 11/2013 Gerenda et al.
2015/0007379 A1 * 1/2015 Cockram ..... A41D 1/06 2/236
2015/0135399 A1 * 5/2015 O'Donnell ..... A41B 3/02 2/129
2017/0231287 A1 * 8/2017 O'Donnell ..... A41B 1/10 2/116

OTHER PUBLICATIONS

Red Kap Performance Shop Pants & Shorts, YouTube video [online]. Red Kap, Mar. 31, 2015 [retrieved on Jun. 18, 2015]. Retrieved from Internet:<URL:https://www.youtube.com/watch?v=MbQmruSqE9Q>.
Duty Pants, Catalog [online] Lion Apparel, Mar. 18, 2013 (retrieved on Jun. 19, 2015). Retrieved from Internet:<URL: https://web.archive.org/web/20130318235725/http://www.lionprotects.com/duty-pants-0>.
Men's DuluthFlex Fire Hose Pants. Catalog [online]. Duluth Trading, Jan. 25, 2014 [retrieved on Jun. 19, 2015]. Retrieved from Internet: <URL:https://web.archive.org/web/20140125014509/http://www.duluthtrading.com/store/product/mens-duluthflex-fire-hose-pants-45507.aspx?#>.

* cited by examiner

PANTS CONFIGURED FOR MOTOR VEHICLE WORKERS

BACKGROUND OF THE INVENTION

1. Field of the Invention

The present invention is directed to pants that are specifically configured for individuals working in the motor vehicle industry. Motor vehicle workers are often faced with work conditions for which conventional clothing does not offer an ideal solution. The pant of the present invention provides a new article of clothing that is specifically configured for use in the motor vehicle industry. The present invention is also directed to pants that are specifically configured for individuals working in industries or under circumstances in which their pants may come into contact with scratchable surfaces.

2. Description of the Related Art

Motor vehicle workers are those individuals that perform any of a variety of work on motor vehicles. They include, for example, individuals employed by motor vehicle manufacturers and the many individuals that perform maintenance, rebuilding, painting, customization, or perform other labor on motor vehicles. This includes, for example, individuals that work on automobiles at dealerships, autoworkers at national franchises such as Jiffy Lube® and Pep Boys®, autoworkers at independent garages, race team workers, custom builders, and other automotive specialists.

Motor vehicle workers typically carry a large number and variety of tools. They also are often forced to work in difficult and uncomfortable positions. Much of their work involves reaching, leaning, stretching, kneeling, squatting, laying on their backs or on their sides, and the like. In many circumstances the clothing of the worker will rub or otherwise have contact with scratchable surfaces on the motor vehicle. Motor vehicle workers are also often forced to work in extreme cold or hot conditions.

Motor vehicle workers typically wear either conventional workpants or jeans. Among the reasons that many motor vehicle workers wear workpants are that they hide stains and can be more effectively laundered, such as by industrial laundering services, to remove grease and other stains. Workpants are also more light weight than jeans and thus cooler in the warm months. Among the reasons that many motor vehicle workers wear jeans are that they are more durable and are thought to provide for a better presentation with working with customers. Neither conventional workpants nor jeans, however, are configured for use in the motor vehicle industry.

SUMMARY OF THE INVENTION

The pant of the present invention is specifically inspired and configured for use in the motor vehicle industry.

Embodiments of the pant are scratchless, meaning that the pant does not have any exposed features, such as buttons, snaps, rivets, and the like, that are capable of scratching the finish on a motor vehicle.

At least one embodiment of the pant comprises a concealed waistband closure mechanism. The concealed waistband closure mechanism comprises a button fastener at a first end of a waistband and a concealed mating button hole at the second end of the waistband. The side of the button hole at which the button rests when in a fastened state, also referred to as the outlet of the button hole, is concealed by a portion of the waistband. The outlet of the button hole is, however, accessible by an access tunnel. The access tunnel preferably spans between the upper surface of the waistband and the lower surface of the waistband. The concealed closure can be formed, for example, by creating a waistband having an extended portion that comprises the button hole, looping the extended portion of the waistband inwardly, and attaching the end of the extended portion to the inner surface of the waistband.

At least one embodiment of the pant comprises at least one scratchless security pocket. The scratchless security pocket has a self-closure mechanism that is configured to predispose the upper flap of the pocket toward a closed position. For example, the upper flap of the scratchless security pocket may be sewn to the leg on each side. Thus, the scratchless security pocket can be maintained in a closed position without the need for any exposed features, such as buttons, snaps, and the like, that are capable of scratching the finish on a motor vehicle.

At least one embodiment of the pant comprises at least one tool-access pocket. The tool-access pocket comprises a first pocket and a second pocket, the first pocket and the second pocket having different depths. The first pocket is configured for holding long tools such as wrenches, screw drivers, finesse sticks, pliers, and the like. The second pocket is configured for holding short tools such as mini screw drivers, smaller wrenches, markers, pen lights, pocket knives, and the like.

Embodiments of the pant are configured to provide enhanced mobility, allowing a wearer to easily reach, lean, stretch, kneel, squat, lay down, and the like without interference from his or her clothing. Embodiments of the pant are also configured to provide enhanced comfort when working in these various positions.

At least one embodiment of the pant comprises a waistband that is configured to stretch so as to provide increased mobility and comfort. The waistband may comprise a band of elastic material. The band of elastic material may be concealed by an outside layer. The outside layer of the waistband is desirably made of a stretchable fabric that allows it to expand in coordination with the elongating of the elastic band. In some embodiments, the rest of the pant or other portions of the pant are also made with the stretchable fabric. The stretchable fabric may, for example, comprise a blend of polyester, cotton, and spandex. In some embodiments, the stretchable fabric is configured to withstand industrial laundering.

At least one embodiment of the pant comprises an articulating, reinforcing knee feature. The articulating, reinforcing knee feature spans each leg of the pant between a region above the knee and a region below the knee. The articulating, reinforcing knee feature comprises at least an outer layer and an inner layer, the multi-layer structure providing reinforcement to the knee region of the pant. This provides durability of the pant at the knee, which is often placed under conditions of heavy wear by motor vehicle workers. Each of the layers is also configured to enhance articulation at the knee by directing extra fabric to a bending point. Accordingly, a wearer may comfortably bend at the knee without the uncomfortable bunching or riding up of fabric on the leg. To enhance articulation at the knees, for example, the layers may each comprise one or more darts running substantially laterally across the leg. The darts may comprise pinches of extra fabric. In this case, the extra fabric is desirably concealed within the leg. For instance, the darts on each of the outer layer and the inner layer may face toward the space between the outer layer and the inner layer so that the extra material is neither visible on the outside of the pant leg nor the inside of the pant leg. This configuration allows for more comfort on the inside of pant leg, by ensuring that there is no seam exposed so as to rub against a wearer's skin.

At least one embodiment of the pant comprises a gusset. For example, the inner length of each leg may comprise two seams (inseams) and the gusset comprises a panel of fabric that is located between the two inseams. The gusset provides enhanced mobility and flexibility of the pant legs.

Embodiments of the pant comprise additional reinforcement features which render them particularly suitable for use by motor vehicle workers. For instance, at least one embodiment of the pant comprises reinforced belt loops that provide enhanced strength. At least one embodiment of the pant comprises one or more reinforced front pockets, which provide enhanced strength and prevent keys and the like from puncturing the pocket and/or leg of the pant.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
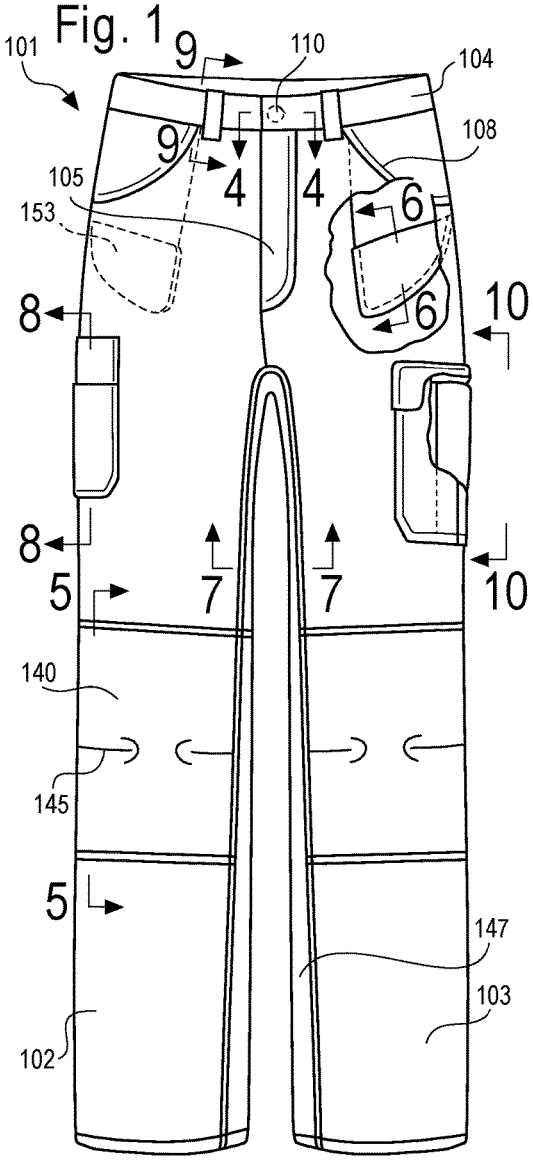
FIG. 1 is a front elevation view of an embodiment of pants configured for use in the motor vehicle industry.
Figure 2:
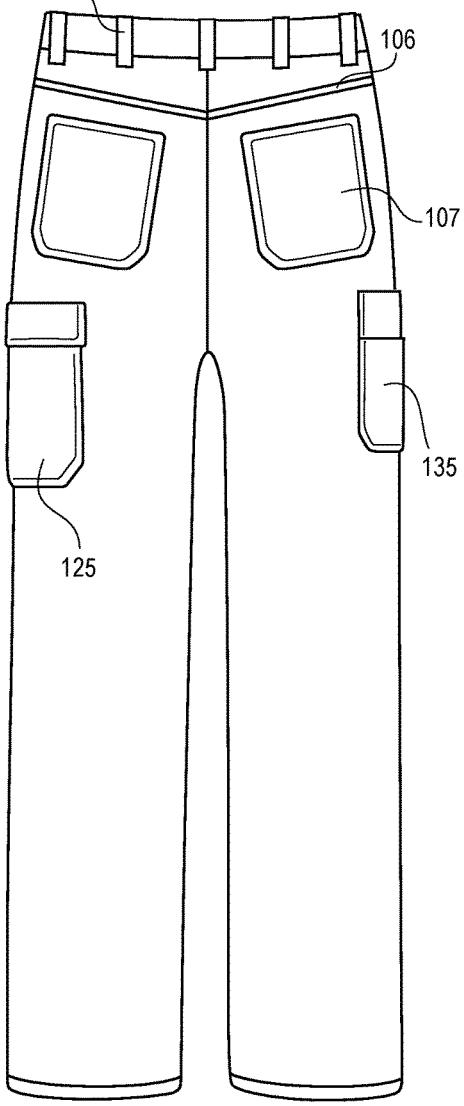
FIG. 2 is a rear elevation view of an embodiment of pants configured for use in the motor vehicle industry.

With reference to FIG. 1, embodiments of the motor vehicle pant 101 comprise a right leg 102, a left leg 103, a waistband 104, and a front closure 105. The ornamental design of the motor vehicle pant 101 may vary. Embodiments of the motor vehicle pant 101, such as the pant illustrated in FIGS. 1 and 2, may comprise elements of traditional denim jeans. For example, the pant 101 may be configured to fit a wearer similarly to traditional jeans. The pant 101 may also comprise stitching elements that are reminiscent of traditional jeans. For example, the pant 101 may comprise a rear riser 106 that is similar to those found on traditional jeans. The pant 101 may also comprise pockets that are similar to those found on traditional jeans. For example, the pant may comprise rear pockets 107 that are similar to those found on traditional jeans. The pant may comprise front pockets 108 that are stitched curved pockets, the type generally used as the front-pockets of jeans. The use of stitched curved front pockets 108, such as are illustrated in FIG. 1 provide the additional benefit in that they are generally more secure and provide easier entry than the side-entry pockets that are found on a conventional work pant. By incorporating elements of traditional denim jeans, the pant 101 may appeal to motor vehicle workers that desire the appearance of jeans without suffering from the flaws inherent in the wearing of jeans while working in the motor vehicle industry, e.g. heat, cost, staining, and lack of mobility.

Embodiments of the motor vehicle pant 101 may also provide the advantages of a conventional work pant. For example, the pant 101 may be made out of a dark fabric that does not show staining. The pant 101 may be made of a breathable fabric that is more breathable than denim and thus cooler in the warm temperatures often encountered by motor vehicle workers. And the pant 101 may be configured so as to be industrially launderable, such that grease stains and the like may be effectively removed.

In addition to providing the advantages of both conventional jeans and workpants, without being subject to the deficiencies of either, embodiments of the motor vehicle pant 101 provides additional features that are specifically configured for use in the motor vehicle industry.

Embodiments of the motor vehicle pant 101 are scratchless, meaning that the pant does not have any exposed features, such as buttons, snaps, and the like, that are capable of scratching or abrading the finish on a motor vehicle. It has been discovered that conventional jeans and work pants often contain buttons, snaps, rivets, and the like, which are capable of scratching or abrading the finish on a motor vehicle. Scratching of a motor vehicle by a workers clothing may occur unknowingly. For example, when a worker reaches across a surface of the vehicle, his or her front button may scratch or otherwise damage the finish of the vehicle. Thus, embodiments of the motor vehicle pant 101 prevent damage to a motor vehicle resulting from the clothing of a motor vehicle worker.

Figure 3:
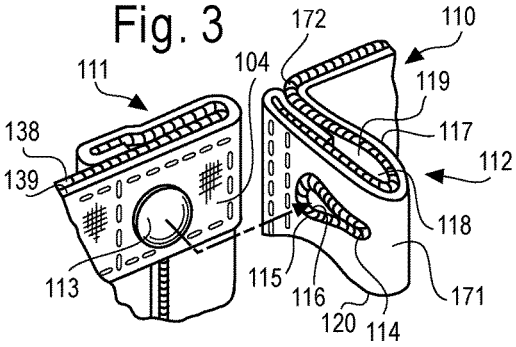
FIG. 3 is a perspective view of an embodiment of a concealed waistband closure mechanism, such as may comprise a feature of pants configured for use in the motor vehicle industry.
Figure 4:
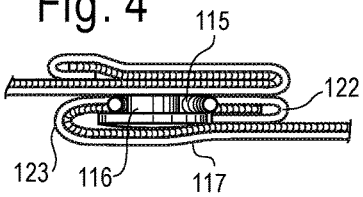
FIG. 4 is a top plan view of an embodiment of a concealed waistband closure mechanism, such as may comprise a feature of pants configured for use in the motor vehicle industry.

At least one embodiment of the pant 101 comprises a concealed waistband closure mechanism 110. The concealed waistband closure mechanism 110 provides that the button or other fastening device, once closed or fastened, is not located on an exposed surface of the pant and thus cannot scratch or abrade the finish on a motor vehicle. An embodiment of the concealed waistband closure mechanism 110 is illustrated in FIGS. 3 and 4. The illustrated embodiment comprises a waistband 104 having a first end 111 and a second end 112. The first end of the waistband 111 comprises a button fastener, or button 113. The second end of the waistband 112 comprises a button hole 114. The button hole 114 is configured to engage with the button 113 so as to keep the first end of the waistband 111 and the second end of the waistband 112 fastened to one another.

The button hole 114 comprises a first side 115, into which the button 113 passes when fastening the pant 101, and a second side 116, which is where the button rests when the pant is in a fastened state. The first side 115 is also referred to as the inlet of the button hole and the second side 116 is also referred to as the outlet of the button hole. The outlet of the button hole 116 is concealed by, for example, a concealing portion of the waistband 117. In this way, when the pant 101 is in a fastened state, the button 113 is concealed, or covered, by a portion of the waistband 117. In the illustrated embodiment, the portion of the waistband 117 is simply a section of the waistband 104, itself. In some embodiments, the portion of the waistband 117 that conceals the outlet of the button hole 116 may comprise an additional piece or strip of fabric that is sewn or otherwise attached to the waistband 104.

The outlet of the button hole 116 is reachable by a wearer through an access tunnel 118. The access tunnel 118 provides that a wearer may reach and operate the button 113 so as to unfasten the pant 101. The access tunnel 118 desirably comprises an opening above the button hole 119 and an opening below the button hole 120. For instance, opening 119 may align with the upper surface of the waistband 104 and opening 120 may align with the lower surface of the waistband. In unillustrated alternative embodiments, the access tunnel 118 might comprise only an opening above the button hole 119 or only an opening below the button hole 120. Operation of the button 113 to unfasten the pant 101 may be more difficult using these configurations however. In yet other unillustrated alternative embodiments, the access tunnel 118 might comprise an opening on the right side of the button hole 114 and/or an opening on the left side of the button hole. However, this configuration is also likely to render operation of the button 113 to unfasten the pant 101 more difficult.

The embodiment of the concealed closure mechanism 110 illustrated in FIGS. 3 and 4 can be formed, for example, by creating a waistband 104 having an extended portion 171 at the second end 112. The extended portion 171 comprises the button hole 114 and a section of material extending beyond the button hole 122. The extended portion 171 is then looped inwardly such that the button hole 114 is located behind a concealing portion of the waistband 117. The point at which the extended portion of the waistband is looped inwardly becomes the outer edge 123 of the second end of the waistband 112. The section of material extending beyond the button hole 122 is attached to an inner surface 172 of the waistband 104, such as by sewing, to create the access tunnel 118. This embodiment of the concealed closure mechanism 110 is capable of being manufactured on a large scale in an efficient and cost-effective manner. While only one manner of forming the concealed closure mechanism is described, based on this disclosure, persons within the garment-making industry would be able to determine alternative ways with which to create a concealed closure mechanism 110. The concealed closure mechanism 110 is in no way limited by any particular method of manufacture.

The pant 101 may be configured to have any arrangement of pockets. It is, however, desirable that the pant 101 include a good number of pockets, as motor vehicle workers often carry a variety of items in their pockets.

It is also desirable that the pant 101 include at least one security pocket. A security pocket is a pocket that comprises a mechanism for preventing objects contained within the pocket from falling out of the pocket when the wearer assumes different positions, such as where the wearer may lay horizontally. In most instances, a security pocket comprises an upper flap. In conventional clothing, the upper flap is held in a closed position by being fastened to the pocket using a button, snap, zipper or the like.

Embodiments of the pant 101 comprise at least one scratchless security pocket 125. The scratchless security pocket 125 comprises a self-closure mechanism that is configured to predispose the upper flap 126 of the pocket toward a closed position. In this way, the scratchless security pocket 125 avoids the need for a fastener such as a button, snap, zipper, or the like, which could unintentionally cause damage to the finish of a motor vehicle.

Figure 10:
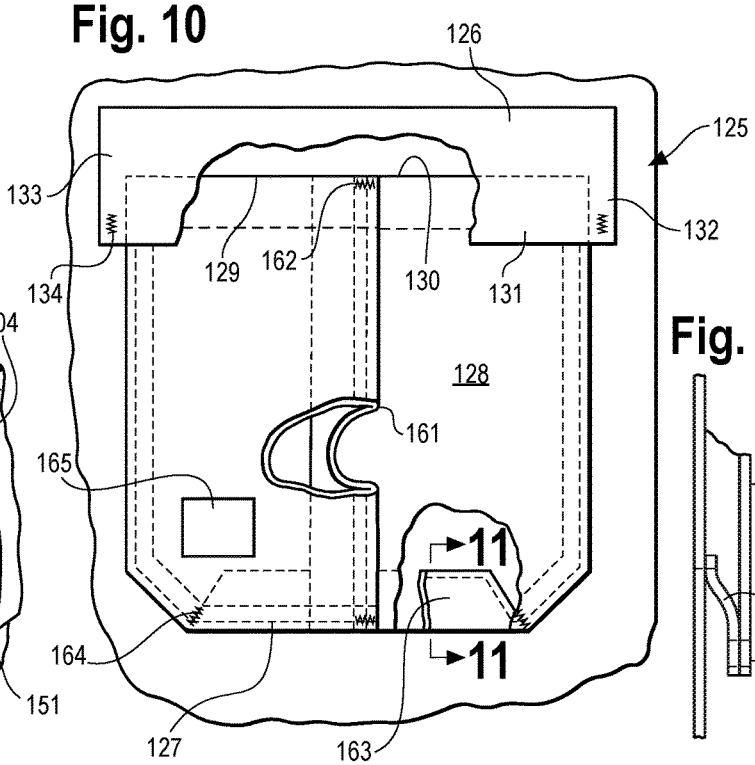
FIG. 10 is a perspective view, partially in cutaway, of an embodiment of a scratchless security pocket, such as may comprise a feature of pants configured for use in the motor vehicle industry.

An embodiment of the scratchless security pocket 125 is illustrated in FIG. 10. This embodiment of the scratchless security pocket 125 comprises a base pocket 128 and an upper flap 126. The base pocket 128 comprises an upper edge 129 that defines the opening of the pocket 130 and a lower edge 127. The upper flap 126 comprises a bottom edge 131, a right side 132 and a left side 133. The bottom edge of the upper flap 131 extends downward over the upper edge of the base pocket 129. Desirably, the bottom edge of the upper flap 131 extends at least about 1 to about 2.5 inches below the upper edge of the base pocket 129, alternatively at least about 1 to about 2 inches below the upper edge of the base pocket 129. This provides that the upper flap 126 adequately seals the opening of the pocket 130 when in its closed position.

The right side of the upper flap 132 and left side of the upper flap 133 are each securely attached to the leg. As illustrated in FIG. 10, for example, the right side of the upper flap 132 and left side of the upper flap 133 are each attached to the leg by a bar tack 134. This predisposes the upper flap 126 toward a closed position. In order to access the scratchless security pocket 125, a wearer simply lifts up on bottom edge of the upper flap 131, thereby exposing the opening of the pocket 130. Once the wearer has placed an article into the pocket or retrieved an article from the pocket, the wearer need only release the upper flap 126 and the pocket will automatically return to a closed configuration. As long as the bottom edge of the upper flap 131 has not become caught behind the upper edge of the base pocket 129, which can easily be prevented by a wearer, the pocket is configured so that in normal use the upper flap 126 will return to a closed position automatically when the hand is withdrawn.

Figure 9:
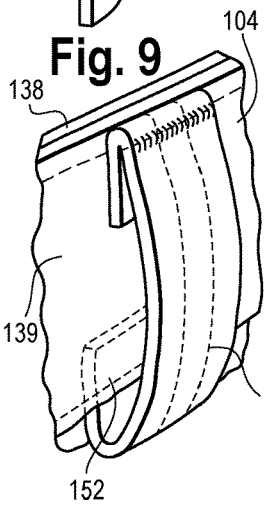
FIG. 9 is a perspective view of an embodiment of a reinforced belt loop, such as may comprise a feature of pants configured for use in the motor vehicle industry.

As shown in the embodiment illustrated in FIG. 10, the base pocket 128 of the security pocket may also comprise a pleat 161. The pleat comprises a fold of additional material that is configured to lay flat when the pocket is empty but to provide for the expansion of the interior of the pocket in order to provide a pocket having an increased holding capacity. The pleat 161 may comprise one or more bar tacks 162 in order to predispose the pleat toward a flat-laying position. For example, in the embodiment illustrated in FIG. 9, the pleat 161 comprises bar tacks 162 at the top of the base pocket (near the top edge 129) and at the bottom of the base pocket (near the bottom edge 127). The pleat 161 is desirably located in the center of the pocket.

Figure 11:
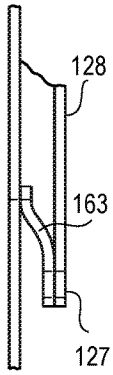
FIG. 11 is a side cutaway view of a portion of an embodiment of a scratchless security pocket, such as may comprise a feature of pants configured for use in the motor vehicle industry.

The base pocket 128 of the security pocket may also comprise an expansion layer of fabric 163 that is configured to be hidden behind the bottom edge 127 of the base pocket when the security pocket 125 is empty. This layer is illustrated, for example, in FIG. 11. In the embodiment illustrated in FIG. 10, the expansion layer of fabric 163 is predisposed to lay substantially flat behind the bottom edge 127 of the base pocket through the use of bar tacks 164 at each end. The expansion layer 163 provides that the security pocket 125 may expand upon placement of an article into the pocket, thereby increasing the holding capacity of the pocket. Through the combined use of a pleat 161 and an expansion layer at the bottom of the base pocket 163, embodiments of the security pocket 125 may provide a visual appearance of a flat pocket but may expand to hold larger articles than one would expect from the visual appearance of the pocket.

As illustrated in FIG. 10, the base pocket 128 of the security pocket may also comprise diagonal corners at the bottom edge. The diagonal corners have been found to prevent small articles that may be placed in the pocket from becoming trapped in the pocket, which is more likely to occur using conventional perpendicular corners. The base pocket 128 of the security pocket may also comprise a patch 165 or other logo that identifies, for example, the brand name of the pant or of the supplier. The label could also be configured to identify a particular company name, such as the name of a garage, race team, or the like.

The scratchless security pocket 125 is desirably located on the outer side of one of the right leg 102 and the left leg 103. In the embodiment illustrated in FIGS. 1 and 2, for example, the scratchless security pocket 125 is located on the outer side of the left leg 103.

It is also desirable that the pant 101 comprise at least one scratchless pocket that is configured for storing tools of different sizes. Accordingly, embodiments of the pant 101 comprise at least one tool-access pocket 135. A tool-access pocket 135 desirably comprises a first pocket 136 and a second pocket 137. The first pocket 136 is deeper than the second pocket 137 and may be configured for holding long tools such as wrenches, screw drivers, finesse sticks, pliers, and the like. The second pocket 137 is shallower than the first pocket 136 and may be configured for holding short tools such as mini screw drivers, smaller wrenches, markers, pen lights, pocket knives, and the like.

Figure 8:
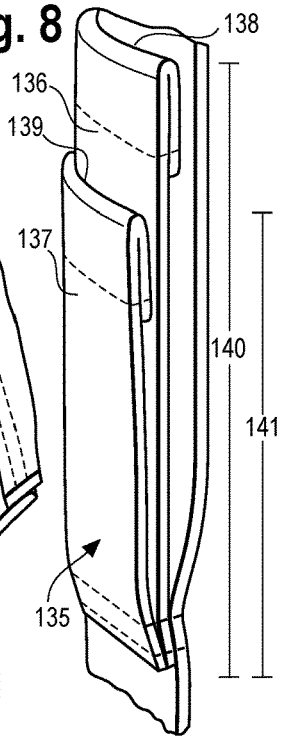
FIG. 8 is a perspective cutaway view of an embodiment of a tool-access pocket, such as may comprise a feature of pants configured for use in the motor vehicle industry.

An embodiment of the tool-access pocket 135 is illustrated in FIG. 8. This embodiment of the tool-access pocket 135 comprises a first pocket 136 and a second pocket 137, with the second pocket being is located outward of the first pocket 136. For example, the second pocket 137 may be sewn directly on top of the first pocket 136. The bottom of the first pocket 136 and the bottom of the second pocket 137 may coincide. However, the opening of the first pocket 138 may be located a distance above the opening of the second pocket 139. Accordingly, the depth of the first pocket 140 may be greater than the depth of the second pocket 141. For example, the depth of the first pocket 140 may be between about 1 to 3 inches greater than the depth of the second pocket 141. Alternatively, the depth of the first pocket may be between about 1.5 to 2.5 inches greater than the depth of the second pocket.

The depth of the first pocket 140 is desirably between about 6 inches and about 10 inches. Alternatively, the depth of the first pocket 140 is between about 7 inches and about 9 inches. Alternatively, the depth of the first pocket 140 is between about 7 inches and about 8 inches. The depth of the second pocket 141 is desirably between about 3 inches and about 8 inches. Alternatively, the depth of the second pocket 141 is between about 4 inches and about 7 inches. Alternatively, the depth of the second pocket 141 is between about 5 and about 6 inches.

The width of the tool-access pocket 135 may be configured to allow access by a wearer's hand, which prevents articles placed in the pocket from becoming trapped inside the pocket. The width of the tool-access pocket 135 may also be configured to provide a secure holding of a particular item, such as a mobile phone. For example, the tool-access pocket 135 may have a width between about 4 inches and about 7 inches, alternatively between about 5 inches and about 7 inches, alternatively between about 5 inches and about 6 inches. In some embodiments, any of the first pocket 136, the second pocket 137, or both the first and second pockets may be configured to have separate compartments for the secure holding of particular tools.

Both pockets 136, 137 are desirably sewn to the leg 102 so as to lay substantially flush with the leg when not holding tools. This may be achieved, for example, through the use of bar tacks located at each side of the opening of the first pocket 138 and/or bar tacks located at each side of the opening of the second pocket 139. The tool-access pocket 135 desirably does not contain any exposed snap or button.

The tool-access pocket 135 allows for the effective storing and organization of various tools. The double pocket configuration also enables a wearer to select in which pocket a particular tool may best be stored. For example, if a wearer is working in close proximity to a motor vehicle such that a tool might scratch the vehicle if it were located in the shallower second pocket 137, the wearer may choose to put tools that might fit in the shallower second pocket 137 in the deeper first pocket 136. Similarly, where the wearer is working in positions in which a tool is likely to fall out of the shallow second pocket 137, the wearer may choose to put tools that might fit in the second pocket 137 in the deeper first pocket 136. On the other hand, where a wearer is repeatedly using the same tool, the wearer may choose to place the tool in the shallow second pocket 137 for easier access.

The tool-access pocket 135 may also comprise diagonal corners as the bottom edge of the first and second pockets. The diagonal corners have been found to prevent small articles that may be placed in the pocket from becoming trapped in the pocket, which is more likely to occur using conventional perpendicular corners. The tool-access pocket 135 may also comprise a patch or other logo that identifies, for example, the brand name of the pant or of the supplier. The label could also be configured to identify a particular company name, such as the name of a garage, race team, or the like.

The tool-access pocket 135 is desirably located on the outer side of one of the right leg 102 and the left leg 103. In the embodiment illustrated in FIGS. 1 and 2, for example, the tool-access pocket 135 is located on the outer side of the right leg 102.

Although the pant 101 may be configured to have any manner of waistband 104, embodiment of the pant comprises a waistband that is configured to stretch so as to provide increased mobility and comfort. Because motor vehicle workers are often working from odd positions, such as squatting or bending at the waist, or stretching to reach various parts of a motor vehicle, a pant 101 having a waistband 104 that is configured to stretch is a substantial improvement over the conventional pants that are typically worn by motor vehicle workers. It is desirable that the waistband 104 is configured to stretch at least about 1 inch, alternatively at least about 1.5 inches, alternatively at least about 2 inches, alternatively at least about 2.5 inches, and alternatively at least about 3 inches.

An embodiment of a waistband 104 that is configured to stretch is illustrated in FIG. 3. In this embodiment, the waistband 104 comprises a band of elastic material 138. The band of elastic material may be a blend of polyester and a rubber material. For example, the band of elastic material may be a blend of between about 60% and 80% polyester and between about 40% and 20% rubber. Desirably, the band of elastic material 138 may be concealed by an outside layer 139. The outside layer 139 may be made of the same fabric as the rest of the exterior of the pant 101 or other portions of the pant. The outside layer of the waistband 139 is desirably made of a stretchable, yet durable, fabric that allows for expansion in coordination with the elongating of the band of elastic material 138. In some embodiments, the rest of the exterior of the pant 101 or portions of the pant are made with the same stretchable and durable fabric.

Embodiments of the pant 101 may also be configured to be capable of withstanding laundering under conditions that are harsher than those used in home laundering processes. For example, in some embodiments, it may be important that the fabric or fabrics that make up the pant are able to withstand industrial laundering. Many motor vehicle industry workers obtain their work wear through a uniform rental program. The garments that are provided by uniform rental programs are washed by a process known as industrial laundering. Industrial laundering must meet a set of standards defined by ISO (the International Organization for Standardization) standards such as ISO 15797 and ISO 30023. For example, in contrast to home laundering processes, which typically take place at about 120° F., industrial laundering takes place at a temperature of at least 150-160° F. Industrial laundering also requires the use of stronger chemicals than those used in a home laundering process. Chemicals used in industrial laundering typically include strong alkali components and strong surfactants. Acids may also be used to bring the pH of a garment to a level that will not irritate the skin. Many industrial laundering processes also employ additional steps that include treatment with agents such as bleaches and/or antichlor compounds. As a result, fabrics that are not configured to withstand the more extreme conditions of industrial laundering may often be destroyed by the process. It is contemplated that embodiments of the motor vehicle pant 101 may be provided to workers in the motor vehicle industry through a uniform rental program. Accordingly, embodiments of the pant 101 may be configured to be capable of withstanding industrial laundering.

The stretchable fabric used as the outer layer of the waistband 139 and optionally throughout other regions of the pant desirably comprises a mixture of a durable fabric such as a blend of polyester and cotton, with a stretchable yarn such as spandex. The stretchable fabric may, for example, comprise a blend of polyester, cotton, and spandex. In some embodiments, the blend of polyester, cotton, and spandex has been specially configured to withstand industrial laundering. The blend desirably comprises between about 1% and about 10% spandex, alternatively between about 1% and about 8% spandex, alternatively between about 2% and about 8% spandex, alternatively between about 2% and about 6% spandex, alternatively between about 3% and about 6% spandex, alternatively between about 3% and about 5% spandex.

Embodiments of the pant 101 provide additional benefits through use of a stretchable fabric either throughout the entirety of the pant (excluding for example pocket linings, etc.) or through strategic use in specific portions of the pant. For example, where stretchable fabric is used in the knee area of the pant, it may provide for increased flexibility of the pant in a region at which wearer movement, and the stresses resulting from wearer movement, often occurs. In order to provide a clean and streamlined visual appearance, it may be desirable to use a stretchable fabric throughout the exterior of the pant.

Embodiments of the pant 101 may also comprise a reinforcing knee feature 140. The reinforcing knee feature 140 provides the wearer with a pant 101 having a knee region that is strengthened relative to other portions of the leg. The knee region may be strengthened, for example, through the use of one or more additional pieces of fabric. In this way, the pant may comprise a knee region having multiple layers. The additional pieces of fabric may be located on the interior of the pant leg or on the exterior of the pant leg. For example, in the embodiment illustrated in FIG. 5, the knee region of the pant may comprise an inner layer 141 and an additional outer layer 142. The use of multiple layers provides reinforcement to the knee region of the pant 101, which is often placed under conditions of heavy wear by workers in the motor vehicle industry.

The one or more additional layers of fabric 142 span the front of the pant leg 102, 103 between a region above the knee and below the knee. It may be desirable for the one or more additional layers to span the front of the pant leg vertically at least a distance 143 between about 4 inches and about 8 inches from a center point 144. The center point 144 is desirably located where it is expected that the knee of the wearer is most likely to contact the pant. Alternatively, it may be desirable for the one or more additional layers 142 to span the front of the pant leg vertically at least a distance 143 between about 5 inches and about 7 inches from the center point 144.

Figure 5:
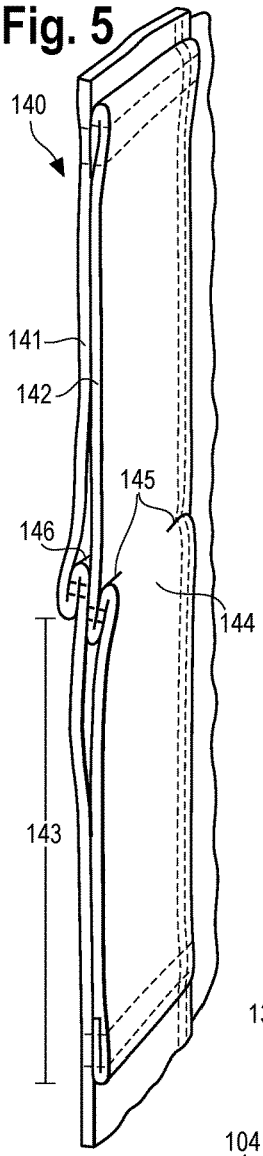
FIG. 5 is a perspective view of an embodiment of a reinforcing and articulating knee feature, such as may comprise a feature of pants configured for use in the motor vehicle industry.

The reinforcing knee feature 140 may also be configured to provide an enhanced articulation of the pant leg 102, 103 at the knee. A pant 101 providing an enhanced articulation of the pant leg at the knee provides a wearer with the ability to more easily and comfortably bend at the knee, such as to squat, without bunching of fabric or riding up of fabric on the leg. The reinforcing knee feature 140 may be configured to provide enhanced articulation by directing extra fabric to a bending point. For instance, the one or more layers of the pant at the knee region 141, 142 may each comprise one or more darts 145 running substantially laterally across the leg. In the embodiment illustrated in FIG. 5, for example, both the outer layer 141 and the additional inner layer 142 comprise a pair of darts 145 at or near the center point 144. While the darts in the embodiment of FIG. 5 are shown as extending from the sides of the leg toward the front of the leg, other configurations are contemplated. It may, however, be desirable to exclude the darts 145 from the region directly surrounding the center point 144 in order to provide more comfort where, for example, a wearer may kneel in the pant. Moreover, while the reinforcing knee feature 140 of the illustrated embodiment comprises only one dart 145 extending from each side, multiple darts such as might be located above and below the center point 144 are also contemplated.

In the illustrated embodiment, the darts 145 each comprise a pinch of extra fabric 146. The pinches of extra fabric 146 are desirably concealed within the leg. For instance, the pinch of extra fabric 146 on the outer layer 141 may face inward toward the additional inner layer 142. And the pinch of extra fabric 146 on the additional inner layer 142 may face outward toward the outer layer 141. By arranging the pinches 146 in this manner, the extra material is neither visible on the outside of the pant leg nor the inside of the pant leg (where it could be abrasive to the leg of a wearer). All that may be visible is a line indicating the presence and location of the dart 145.

Figure 7:
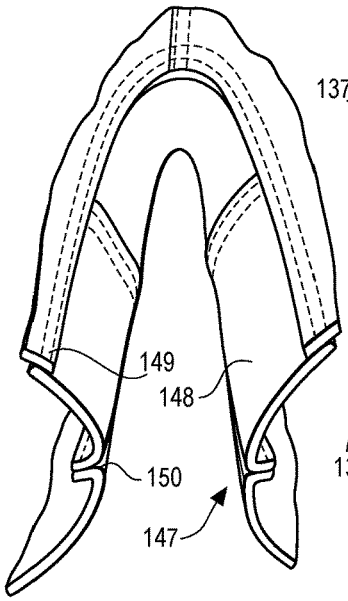
FIG. 7 is a perspective view of a portion of an embodiment of a gusset, such as may comprise a feature of pants configured for use in the motor vehicle industry.

Some embodiments of the pant comprise a gusset 147. The gusset 147 comprises an extra panel of fabric 148 on the leg 102, 103 that allows the leg to better move with the wearer across a greater range of flexibility. In the embodiment illustrated in FIG. 7, the extra panel 148 is located on the inner length of each leg 102, 103 and spans laterally between a pair of inner seams 149, 150. For example, in the embodiment illustrated in FIGS. 1 and 7, the gusset 147 extends from the bottom of the right leg 102, up around the underside of the crotch and down to the bottom of the left leg 103. This configuration provides a wearer with an enhanced range of flexibility without having the pant 101 restrict movement. It also provides increased comfort across a wide range of movements.

Embodiments of the pant 101 also comprise one or more reinforced belt loops 151. Many motor vehicle industry workers latch keys and the like onto a belt loop. This puts stress on the belt loop, which may lead to breakage of the seam connecting the belt loop with the pant. The reinforced belt loop 151 is able to withstand greater stresses than a conventional belt loop. The reinforced belt loop 151 may comprise a belt loop that, in addition to being sewn to the pant, is tucked underneath a panel of fabric. In the embodiment illustrated in FIG. 9, for example, the bottom of the reinforced belt loop 152 is tucked underneath the outer layer of the waistband 139, and tacked with a reinforced stitch, such as a bar tack. Because the lower seam connecting the reinforced belt loop 151 to the pant 101 is not visible, the reinforced belt loop may also render the pant more visually appealing.

Figure 6:
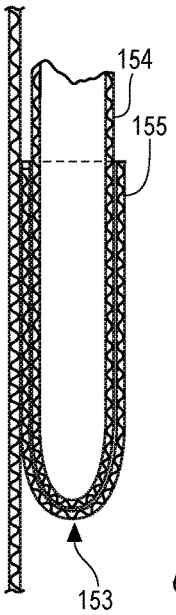
FIG. 6 is a perspective view of an embodiment of a reinforced front pocket, such as may comprise a feature of pants configured for use in the motor vehicle industry.

Some embodiments of the pant 101 comprise one or more reinforced front pockets 153. Motor vehicle industry workers often keep objects, such as keys or pocket knives, in the front pocket of their jeans or workpants. Over time, wear from these objects will often create a hole in the front of the pant leg and/or in the pocket itself. The reinforced front pocket 153 prevents objects stored in a front pocket from puncturing or otherwise damaging the pant. In the embodiment illustrated in FIG. 6, the reinforced front pocket 153 comprises a pocket lining 154 that comprises at least one additional layer of fabric 155. The additional layer or layers of fabric 155 may be located only at a bottom portion of the pocket, as illustrated. Alternatively, the additional layer or layers of fabric 155 may coordinate with the entirety of the pocket lining 154. Desirably, both of the front pockets are reinforced front pockets 153. Alternatively, only one front pocket may be a reinforced front pocket 153.

The pant 101 may be made of any of a variety of materials. In some embodiments, the pant 101 may be made, in whole or part, out of a stretchable fabric described above. In some embodiments, the pant 101 may be made, in whole or part, out of a fabric having an enhanced breathability such as canvas or the like. In other embodiments, the pant 101 may be made, in whole or part, out of twill or other flatweave fabric, or other textured fabrics such as ripstop fabrics. The pant 101 can be manufactured using conventional manufacturing techniques that are known within the garment-manufacturing industry.

A prototype of an embodiment of the motor vehicle pant 101 of the present invention was subjected to a wear test in order to assess the performance of the pant in the setting of its intended use within the motor vehicle industry. Eighty-six motor vehicle industry workers from dealerships, national franchises, independent garages, and race teams completed the wear test. In the wear test, each participant was provided a pair of pants according to the embodiment illustrated in FIGS. 1 and 2. The pair of pants comprised a combination of the features described above—a concealed waistband closure mechanism 110, a scratchless security pocket 125, a tool-access pocket 135, a stretchable waistband 104, reinforced and articulatable knees 140, a leg gusset 147, reinforced belt loops 151, and reinforced front pockets 153. The pant 101 was also made of a stretchable yet durable fabric as described above. Each participant was asked to wear and wash each pair of pants as frequently as possible over a two week period. During this period, each participant was contacted by telephone and email with reminders to wear and wash the pants. At the end of the two week period, each participant participated in a survey that was designed to judge the performance of the pant in terms of mobility, comfort, and functionality. The survey was also constructed to demonstrate the overall improved performance of the pant in comparison to conventional work pants.

In a test of overall satisfaction, 78% of participants indicated that they were "very satisfied" or "satisfied" with the prototype pant, in contrast to only 33% of participants that were "very satisfied" or "satisfied" with the pants that they currently wear to work. Also, in comparison to their current uniform, 86% of participants indicated that the prototype pants were better or somewhat better than their current pants.

The prototype pants were also compared with conventional pants across a number of performance attributes, including durability, mobility, pockets, quality, comfort, material, professional appearance, and fit. The prototype pants were preferred by significant margins across each attribute. For example, 85% of participants preferred the durability of the prototype to their current pants, 85% of participants preferred the mobility of the prototype to their current options, 81% of participants preferred the pockets of the prototype to those of their current pants, and 78% of participants preferred the comfort of the prototype to that of their current pants.

The participants were also asked to describe which feature or combination of features was most important to their determination that the prototype pants were superior to their conventional work pants. The responses showed that combinations of the features were found to provide a significant improvement over conventional work pants. For example, the high ratings of the prototype were due in many instances to the combination of the concealed button 110 and the scratchless security pocket 125. In other instances, the high ratings of the prototype appear to be due to the combination of the pockets 125, 135 and the improved mobility provided by the waistband 104, the leg gusset 147, the articulatable knee 140 and the like. In yet other instances, the most significant improvement was found to be the combination of the concealed button 110 and the improved mobility provided by the stretchable fabric. In other instances, the combination of the concealed button 110 and the reinforced knee areas 140 was found to provide a significant improvement over conventional pants. And in other instances, the combination of the concealed button 110 and the reinforced front pockets 153 was found to provide a significant improvement over conventional pants. Most of the participants responded that some combination of the features rendered the prototype pants especially suitable for use in their work settings.

Although the present invention has been described in terms of being a work pant, a work short having any combination of the above-described features is also contemplated.

It can be seen that the described embodiments provide a unique and novel pant configured for motor vehicle workers that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A pant comprising:

a. a waistband having a top end, a bottom end, an inner surface, an outer surface, a first end, and a second end, b. a button at the first end, and c. a concealed closure at the second end, the concealed closure comprising an access tunnel formed by an extended portion of the second end being looped toward the inner surface and attached to the inner surface, the access tunnel defined by the extended portion, a concealing portion of the waistband, a top edge, and a bottom edge, the access tunnel being open at the top edge and the bottom edge, the extended portion comprising a button hole having an inlet and an outlet, wherein the outlet of the button hole is behind the concealing portion of the waistband and the outlet of the button hole is accessible by the access tunnel; and wherein the pant does not have any exposed buttons or snaps.

2. The pant of claim 1, wherein the waistband is configured to stretch.

3. The pant of claim 2, wherein the waistband comprises a band of elastic material.

4. The pant of claim 3, wherein the elastic material is concealed by an outside layer of the waistband.

5. The pant of claim 4, wherein the outside layer of the waistband is made of a stretchable fabric that comprises polyester, cotton, and spandex.

6. The pant of claim 5, wherein the pant comprises first and second legs and wherein the first and second legs are also made of said stretchable fabric.

7. The pant of claim 5, wherein the stretchable fabric comprises between about 1% and about 8% spandex.

8. The pant of claim 7, wherein the stretchable fabric comprises between about 3% and about 6% spandex.

9. The pant of claim 5, wherein the stretchable fabric is configured to withstand industrial laundering.

10. The pant of claim 1, wherein the pant comprises first and second legs and wherein a knee portion of each of the first and second legs is reinforced.

11. The pant of claim 10, wherein the knee portion of each of the first and second legs is configured to provide an enhanced articulation of a leg at a knee.

12. The pant of claim 11, wherein the knee portion of each of the first and second legs comprises at least an inner layer and an outer layer and each of the inner layer and the outer layer comprises one or more darts running substantially laterally across the knee portion.

13. The pant of claim 1, wherein the pant comprises first and second legs, further comprising a security pocket on at least one of the first and second legs, wherein the security pocket has a flap that is predisposed toward a closed position by having a right side of the flap and a left side of the flap attached to the at least one of the first and second legs.

14. The pant of claim 1, wherein the pant comprises first and second legs, further comprising a tool-access pocket on at least one of the first and second legs, the tool-access pocket comprising a first pocket and a second pocket, a depth of the first pocket and a depth of the second pocket differing by between about 1 inch and about 3 inches.

15. The pant of claim 1, wherein the waistband comprises at least an inner layer and an outer layer and wherein at least one belt loop is tucked underneath the outer layer of the waistband.

16. The pant of claim 1, further comprising at least one front pocket, wherein the at least one front pocket is a reinforced pocket having a pocket lining comprising more than one layer of fabric.

17. The pant of claim 1, wherein the pant comprises first and second legs and wherein the first leg comprises two inner seams, the two inner seams of the first leg being separated by a gusset, and the second leg comprises two inner seams, the two inner seams of the second leg being separated by the gusset.

18. The pant of claim 1, wherein the button and the button hole are part of a front closure.

* * * * *